United States Patent [19]

Arntyr et al.

[11] Patent Number: 4,486,122

[45] Date of Patent: Dec. 4, 1984

[54] METHOD AND DEVICE FOR REDUCING THE RISK OF FREEZING OF SURFACE-WATER PIPE-LINE SYSTEMS

[76] Inventors: Oscar S. Arntyr, Wallingatan 37, S-111 24 Stockholm; Thord I. Engström, S-950 18 Bensbyn, both of Sweden

[21] Appl. No.: 433,121

[22] PCT Filed: Feb. 11, 1982

[86] PCT No.: PCT/SE82/00043

§ 371 Date: Sep. 23, 1982

§ 102(e) Date: Sep. 23, 1982

[87] PCT Pub. No.: WO82/02913

PCT Pub. Date: Sep. 2, 1982

[30] Foreign Application Priority Data

Feb. 16, 1981 [SE] Sweden ..... 8101045

[51] Int. Cl.[3] ..... E03B 5/04

[52] U.S. Cl. ..... 405/157; 52/20; 98/119; 137/846; 404/25; 405/154; 405/118

[58] Field of Search ..... 405/87, 118–121, 405/154, 157; 52/20; 404/25; 137/846, 853, 852; 98/119

[56] References Cited

U.S. PATENT DOCUMENTS

| | | | |
|---|---|---|---|
| 152,450 | 6/1874 | Young | 98/119 X |
| 3,060,882 | 10/1962 | Peters et al. | 137/846 X |
| 3,111,078 | 11/1963 | Breckenridge | 98/119 |
| 3,118,468 | 1/1964 | Bochan | 137/846 |
| 3,121,384 | 2/1964 | Brode | 98/119 |
| 3,473,559 | 10/1969 | Warren | 98/119 X |
| 3,621,623 | 11/1971 | Downes | 404/25 |
| 4,305,679 | 12/1981 | Modi | 52/20 X |
| 4,355,197 | 10/1982 | Jonsson | 404/25 X |

*Primary Examiner*—Dennis L. Taylor

*Attorney, Agent, or Firm*—Sughrue, Mion, Zinn, Macpeak & Seas

[57] ABSTRACT

A method for reducing the risk of freezing of surface-water pipe-line systems of the kind comprising a plurality of drains and other inlets, such as rain-water drains, manholes and inlets from terrace and roof guttering, etc. Means are provided which prevent or reduce air currents in at least one of the drains and other inlets through which the flow of air would otherwise be excessive. The means is designed to permit water to flow therethrough without appreciable gathering of water therein.

6 Claims, 6 Drawing Figures

METHOD AND DEVICE FOR REDUCING THE RISK OF FREEZING OF SURFACE-WATER PIPE-LINE SYSTEMS

The present invention relates to a method and a device for reducing the risk of freezing of surface-water pipe-line systems which include a plurality of drains and other inlets, such as street drains, menholes, inlets from terrace and roof gutters, etc.

In regions of extreme cold the rain-water drains often freeze, resulting in great expense in thawing of the drains, and creating difficulties and costs as a result of flooding due, for example, to the melting of large quantities of snow. Freezing does not only occur in the actual intake of the drain, but also lower down in the pipe at a level which is normally considered free from frost. Various methods have been tried in an attempt to facilitate thawing of frozen pipes, one method being to provide the pipes with electric heating cables. This does not solve the basic problem of freezing, however, but merely simplifies thawing of the pipes when they are frozen.

The present invention is based on research in the causes of such freezing problems, and to provide means for eliminating or reducing these causes.

The present invention is based on the knowledge that a surface-water pipe-line system is normally so dimensioned that only a minor part of the total capacity is utilised under normal conditions. Drains and pipes forming part of a pipe-line system form a communicating system which permits air to pass freely between the various open connecting locations of the system. Large volumes of air can be carried in such a system, among other things because different drains lie at different levels. Moreover, certain inlets, for example terrace and roof gutters, can be connected to the system via drainpipes incorporated in heated buildings. At low ambient temperatures, for example, this gives rise to a marked chimney effect, causing cold air to be drawn into the system through the lowermost drains and to pass out through the highest drains. Strong air currents are also created by the pressure differences during a strong wind between the drains located on the windward side and those located on the leeward side of, for example, a large building.

During the wintertime, these air currents cause large volumes of very cold ground air to be drawn down into the pipe-line system, causing drains and adjacent pipe networks to quickly freeze-up, even at levels which are normally considered frost free, resulting in ice plugs, frost lift and other damage.

Thus, the invention is based on the understanding that freezing of surface-water systems is caused to a large extent by the cold ambient air drawn down into the system as a result of the strong air currents liable to occur in the system, as explained in the aforegoing. The problems created by air-flows through the pipe system could be solved by using known surface-water drains provided with water seals or traps, said seals either being incorporated in the drain or separate therefrom. In those regions which experience the problem of freezing according to the aforegoing it is not possible, however, to utilise a water seal or the like, since the seal would freeze.

As previously mentioned, a surface-water pipeline system must be excessively dimensioned relative to the normal quantities of surface water, and in principle constitute a communicating system within a restricted take-up area. Consequently, it is not possible to cut-off the airflow completely without endangering the function of the system.

The solution afforded by the present invention restricts the freedom to which the air can move freely in the pipe-line system to values which can be accepted in relation to the climate, without encroaching on the requirement for full water transportation Accordingly, the invention is characterized by arranging means for preventing or reducing the flow of air in at least one of the drains and other inlets through which the flow of air would otherwise be excessive, said means being arranged so as to permit water to flow therethrough without any appreciable gathering of the water.

A preferred embodiment is characterized in that said means includes a spring-biassed air seal or trap arranged in the upper end of a respective drain or other inlet. The air seal may comprise a funnel-shaped sleeve of flexible, substantially gas-impermeable material, the lower end of which sleeve is normally held sealed by means of at least one spring so mounted that it attempts to flatten the lower opening of the sleeve by stretching. The spring preferably comprises a leaf spring attached at its ends to the lower edge of the sleeve. If so desired, the lower end of the sleeve may be cut obliquely, to enable draining of small quantities of water.

In an alternative embodiment, the air seal includes at least two rubber lips which resiliently abut each other. In this respect, the air seal may include a central, cupola-like rubber shell and a surrounding, rubber lip arranged to lie against the lower edge portion of the cupola.

The invention will now be described in more detail with reference to the accompanying drawings, which illustrate a preferred embodiment.

Figure 1:
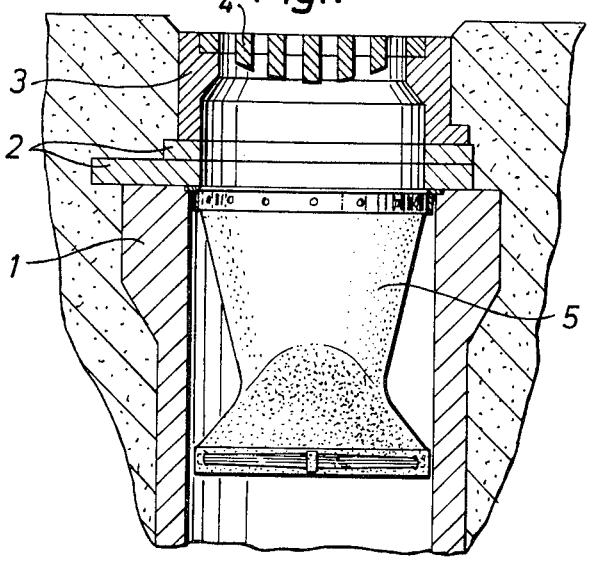
FIG. 1 is a sectional view of a rain-water drain having an air seal according to the invention.

FIG. 1 illustrates the upper part 1 of a rainwater drain. Arranged on the upper part 1 of the drain are two raising and adjusting rings 2, and a cover 3 provided with a grating or grid 4. Arranged adjacent the upper edge of the part 1 of the drain is a means 5 which in the illustrated embodiment comprises a two-directional air seal or lock, through which water can pass down into the drain without gathering in the air seal. Thus, the air seal 5 is intended to prevent strong currents of air from passing down into the drain from the surroundings and also from passing up through the drain and out into atmosphere. The direction in which the air flows through the drain can namely vary in dependence on the ambient pressure conditions and also in dependence on the level at which the drain is located, i.e. if the location of the drain is one of the lower or higher locations of the system. Thus, the same air seal can be used both with rain-water drains located at low levels and intake drains connected to drainpipes incorporated in buildings and intended to carry away rainwater from roofs, terraces and the like. The site at which the air seal is located is selected so that said seal lies on a level in the drain where freezing would not normally occur because water flowing through the pipes connected to the drain maintains said location at a temperature somewhat above freezing.

Figure 2:
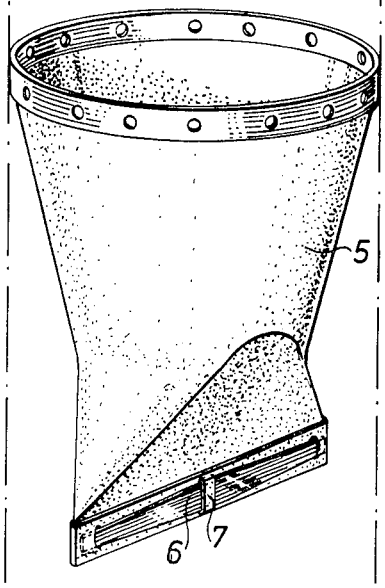
FIGS. 2 and 3 illustrate the air seal shown in FIG. 1 in a closed and open position respectively.
Figure 3:
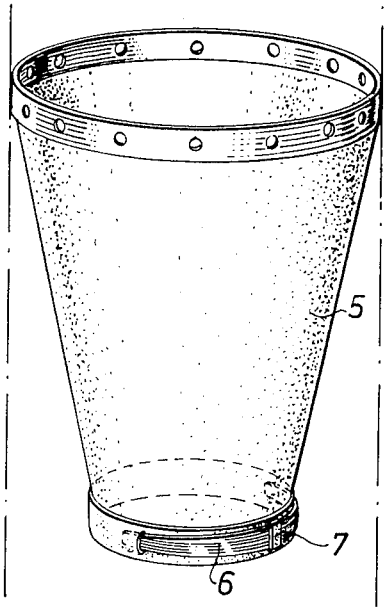

As will best be seen from FIGS. 2 and 3, the air seal comprises a funnel-like bag or sleeve 5 of flexible, substantially gas-impermeable material. A leaf spring 6 having a length which substantially corresponds to half the circumference of the lower, narrow end of the sleeve is held at its end to the lower edge of the sleeve 5. The spring 6 slideably extends through a holder 7. In its normal position, the spring 6 attempts to flatten out the lower opening of the sleeve 5 by stretching, so as to close said opening, as shown in FIG. 2. In this position the passage of strong air currents through the drain in both directions is prevented.

In the event of rain or large amounts of water due to snow melting, the sleeve 5 will be opened to its fullest extent by the force exerted by the water flowing down thereinto, as illustrated in FIG. 3. The strength of the spring 6 can be selected so that even a relatively small amount of water is able to open the sleeve, said sleeve thus remaining substantially fully open until the flow of water to the sleeve ceases, at which time the spring 6 will return to the state illustrated in FIG. 2 and close the sleeve. The funnel-like shape of the sleeve 5 has been chosen so that the lower end of the air seal can be closed, in the manner shown in FIG. 2, without coming into contact with the walls of the drain 1. The air seal may also be of conical configuration over solely a part of its length and of circular-cylindrical configuration over the remainder of its length.

In the aforedescribed embodiment only one single leaf spring 6 is required, said spring being completely protected from the water flowing through the drain, thereby rendering the device extremely reliable in operation and minimising the need for maintenance. As will be understood, if necessary a corresponding spring can also be arranged around the other half of the sleeve. The effect obtained with the leaf spring 6 can also be obtained with coil springs, by arranging the springs so that they attempt to flatten out the lower end of the sleeve by stretching. The use of a leaf spring to effect the closing and opening of the seal is more expedient, however, since the leaf spring tends to switch rapidly between the states illustrated in FIGS. 2 and 3.

Thus, an air seal according to the aforegoing fulfills its function of preventing undesirable air currents through the drain while not encroaching on the ability of the drain to allow water to pass therethrough and while not allowing large quantities of water to collect, which might freeze. The water seal can also be readily installed in existing drains and may be suspended, for example, from a flange clamped between two drain sections. The level at which the air seal is placed can be selected, inter alia, with view to the risk of freezing and with view to the requirement of access.

Figure 4:
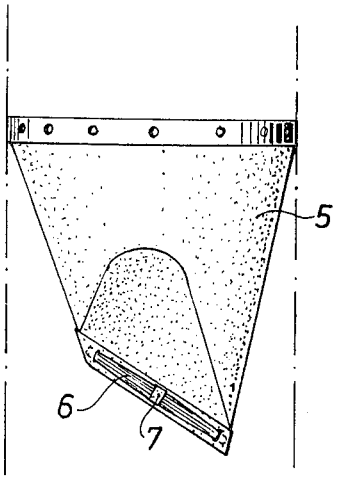
FIG. 4 illustrates a variant of the air seal shown in FIGS. 1–3.

FIG. 4 illustrates an alternative embodiment of the air seal illustrated in FIGS. 1–3, the lower end of the funnel-shape sleeve being cut obliquely. When only a small amount of water flows down into the drain, this embodiment of the seal enables the water to seep therethrough, optionally through a small opening obtained adjacent the lower edge of the otherwise closed opening. This avoids the necessity of opening the air seal completely solely for the passage of small quantities of water. As will be understood, a fully open sleeve without the opening being substantially filled by the water passing therethrough would enable those air currents which are to be prevented according to the invention to pass through the drain.

Figure 5:
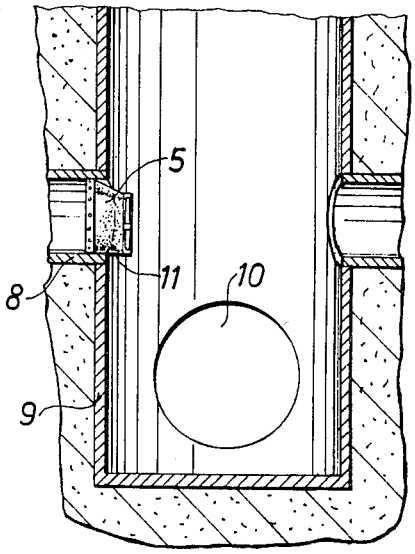
FIG. 5 illustrates an air seal according to the invention mounted in a collecting drain.

FIG. 5 illustrates an air seal according to the invention arranged in the inlet pipe 8 of a collecting drain or main drain 9, from which incoming water flows out through a collecting line 10. The air seal 5 is principally of the same design as the air seal shown in FIGS. 1–3, although in this embodiment the seal is provided with a straight edge 11 for preventing undesirable damming of water in the line 8.

The flexible sleeves of the air seals illustrated in FIGS. 1–5 are suitably made of a woven glass-fibre or polyester material coated with silicon or Teflon for preventing snow and ice fastening to the sleeve.

Figure 6:
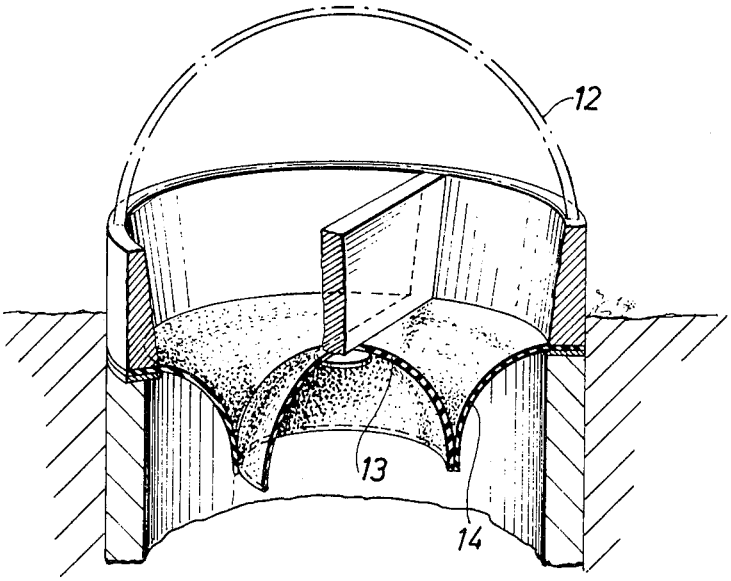
FIG. 6 illustrates a further embodiment of an air seal according to the invention.

FIG. 6 illustrates an alternative embodiment of an air seal according to the invention, intended to be positioned immediately beneath the grating 12 of rainwater drains. In this case, it is not pssible to avoid the risk of the actual air seal freezing during the wintertime. Consequently, the air seal has been designed to permit freezing and to facilitate thawing. The air seal is also so designed that if, for example, a stone falls down into the drain the seal will only open locally, thereby to avoid unnecessary air currents through the drain.

The air seal illustrated in FIG. 6 comprises a central, cupola-like shell 13 made of a suitable rubber material, and an outwardly lying, arched collar-like body 14 made of a corresponding grade of rubber. Thus, the bodies 13 and 14 together form two mutually abutting lips, which prevent air from flowing in either direction, but which can be opened to permit water to flow down through the drain. A suitable rubber material for the air seal shown in FIG. 6 is, for example, butyl rubber, on which ice and snow will not fasten.

The embodiment illustrated in FIG. 6 can also be used with rectangular drains. In this case, the rubber elements have the form of linear rubber strips arranged to resiliently abut each other along their longitudinal edges.

All of the air seals described above are constructed so that hoses of large diameter can be passed down therethrough, for sludge-removing or thawing purposes. The seals, however, effectively prevent the passage of undesirable airstreams and are designed so that they can be fitted to drains of various shapes by means of different attachment devices. Air seals according to the invention can be placed directly in the gratings of drains or at a desired level therebeneath and may also be combined, for example, with existing so-called sand traps. The design of the air seal itself can, however, be varied in several respects within the scope of the claims.

I claim:

1. Pipe-line system for surface-water including a plurality of drains and other inlets, such as rain-water drains, manholes and inlets from terrace and roof guttering, etc., characterized in that in order to reduce the risk of freezing of the system special means (5) are mounted in at least some of the drains (1) or other inlets which are so located that the flow of air therethrough can be heavy, said means (5) being arranged to reduce such heavy flow of air in both directions through the respective drain but not to prevent some ventilation of the system and designed to permit a small flow of water to pass directly therethrough without appreciable gathering of water in said means and to be automatically opened when required to permit a greater flow of water to pass.

2. A pipe-line system according to claim 1, characterized in that said means comprises a spring-biassed air seal (5) arranged in the upper end of respective drains (1) or other inlet.

3. A pipe-line system according to claim 2, characterized in that the air seal comprises a funnel-shaped sleeve (5) made of a flexible, substantially gas-impermeable material, the lower end of which sleeve is normally held closed by means of at least one spring (6) so arranged that it attempts to flatten out the lower opening of the sleeve by stretching.

4. A pipe-line system according to claim 3, characterized in that said spring comprises a leaf spring (6) held at both ends to the lower edge of the sleeve (5).

5. A pipe-line system according to claim 3 or claim 4 characterized in that the lower end of the sleeve (5) is cut obliquely.

6. A method for reducing the risk of freezing of a surface-water pipe-line system which comprises a plurality of drains and other inlets, such as rain-water drains, manholes and inlets from terrace and roof guttering, etc., characterized by providing special means in at least some of the drains and other inlets which are so located that the flow of air therethrough can be heavy, and designing said means to reduce such heavy flow of air in both directions through the respective drain, but not to prevent some ventilation of the system, and to permit a small flow of water to pass directly therethrough without appreciable gathering of water in said means and to be automatically opened when required to permit a greater flow of water to pass.

* * * * *